US010643432B1

(12) United States Patent
Abrahamson et al.

(10) Patent No.: US 10,643,432 B1
(45) Date of Patent: May 5, 2020

(54) SECURE SPORTS GAMING SYSTEMS AND METHODS

(71) Applicants: Jamie Abrahamson, Las Vegas, NV (US); Richard Newman, Henderson, NV (US)

(72) Inventors: Jamie Abrahamson, Las Vegas, NV (US); Richard Newman, Henderson, NV (US)

( * ) Notice: Subject to any disclaimer, the term of this patent is extended or adjusted under 35 U.S.C. 154(b) by 0 days.

(21) Appl. No.: 16/292,312

(22) Filed: Mar. 4, 2019

Related U.S. Application Data

(60) Provisional application No. 62/637,447, filed on Mar. 2, 2018.

(51) Int. Cl.
*G07F 17/32* (2006.01)

(52) U.S. Cl.
CPC ..... *G07F 17/3288* (2013.01); *G07F 17/3223* (2013.01); *G07F 17/3244* (2013.01)

(58) Field of Classification Search
CPC ..... G07F 17/32
See application file for complete search history.

(56) References Cited

U.S. PATENT DOCUMENTS

| | | | | |
|---|---|---|---|---|
| 10,318,879 | B2 * | 6/2019 | Lopez | H04L 67/36 |
| 2012/0046095 | A1 * | 2/2012 | Shore | G07F 17/3244 463/25 |
| 2016/0210815 | A1 * | 7/2016 | Holt | G07F 17/3244 |

* cited by examiner

*Primary Examiner* — Reginald A Renwick
(74) *Attorney, Agent, or Firm* — Newman Law, LLC

(57) ABSTRACT

Systems and methods of providing a secure gaming device including one or more game protection elements for ensuring the integrity and unassailability of game outcomes while providing an appealing mix of game features involving a wide range of various potential payout awards.

3 Claims, 11 Drawing Sheets

SECURE SPORTS GAMING SYSTEMS AND METHODS

CROSS REFERENCE TO RELATED APPLICATIONS

This application claims the benefit of priority to U.S. provisional patent application No. 62/637,447 filed on Mar. 2, 2018, the entire contents of which is incorporated herein by reference for all purposes.

BACKGROUND OF THE INVENTION

The invention relates generally to the field of gaming, and particularly to the field of sports gaming.

Wagering on sports is a multi-billion dollar business. Casinos, for example, have large sports and event betting parlors for attracting bettors. These parlors display the bets that a person may make on various sporting events. Bets are placed on most major sports including professional and college football, soccer, baseball, basketball, auto racing, and ice hockey, as well as cricket and rugby. Bets are placed on various sports tournaments, including the NCAA Men's and Women's Basketball Championships and World Cup Soccer.

While wagering on sports is popular, there are not as many sports bettors as bettors in other forms of gaming. One reason is that sports wagering is perceived as requiring detailed or special knowledge. Another reason is the suspicion that sports betting is susceptible to cheating. Indeed, nearly a century after the infamous "Black Sox" scandal of 1919, the negative link between sports wagering and game integrity remains a top concern for sports leagues. It is envisioned that the issue of game integrity in light of sports wagering will receive enhanced scrutiny as sports wagering operations expand throughout the United States. For these reasons and others, the business of providing sports wagering can be extremely financially risky, particularly during big games, with a relatively low return compared to the total amount wagered (the "handle"). Given the risks, ensuring the security and integrity in gaming is of critical importance.

Game security has been the subject of many previous patents, including U.S. Pat. Nos. 2,764,821; 2,961,777; 2,986,820; 3,055,117; 3,508,344; 2,210,879; 3,823,022; 2,410,800; 3,877,155. While these patents have increased the security of gaming by producing acceptable solutions to problems encountered, they have not provided the answer to more sophisticated methods of compromise and collusion in every form of gaming, particularly sports betting.

Consequently, it is an object of the present invention to provide a gaming systems, methods and devices which require no prior knowledge and reduce operator and player risk by employing features that provide greater game security and integrity.

SUMMARY OF THE INVENTION

The invention is directed to systems and methods of providing a secure gaming device including one or more game protection elements for ensuring the integrity and unassailability of game outcomes while providing an appealing mix of game features involving a wide range of various potential payout awards.

Some embodiments of the invention are directed to a system for secure sports wagering, comprising a game server including a computing device in communication with a communication network, a user device and a random number generator, the computing device comprising a processor and a memory device configured to store a plurality of parameters, each parameter of the plurality relating to statistical data generated by a sporting event, a plurality of variables relating to each parameter of the plurality of parameters, each variable relating to a preset participant in the sporting event, a plurality of potential outcomes and a plurality of executable instructions stored therein, the system being configured to: actuate the game server to generate a display on the user device of the plurality of parameters; receive a selected parameter from the user device; display one or more variables relating to the selected parameter on the user device; receive a selection of one or more variables for the selected parameter from the one or more variables displayed on the user device; randomly assign a potential outcome from the plurality of potential outcomes to each combination of the selected parameter and the one or more selected variables; compare the potential outcome for each combination of the selected parameter and the one or more selected variables with actual sporting event data received through the communication network; and distribute a payout responsive to the potential outcome for each combination of the selected parameter and the selected one or more variables at least partially corresponding with the actual sporting event data.

Some embodiments of the invention are also directed to a system for secure sports wagering, comprising a game server including a computing device in communication with a communication network, a user device and a random number generator, the computing device comprising a processor and a memory device configured to store a plurality of statistical categories of data collected from one or more sporting events, a plurality of participants in the one or more sporting events, a plurality of potential outcomes for the sporting event and a plurality of executable instructions stored therein, the system being configured to: actuate the game server to generate a display on the user device of the plurality of statistical categories of data collected from one or more sporting events; receive a selected statistical category of data from the user device; display the plurality of participants in the one or more sporting events relating to the selected statistical category of data; receive a selection of one or more participants from the plurality of participants displayed on the user device; randomly assign a potential outcome from the plurality of potential outcomes to each combination of the selected statistical category of data and selected participant; compare the potential outcome for each combination with actual sporting event data involving the participant received through the communication network; and distribute a payout responsive to the potential outcome for each combination at least partially corresponding with the actual sporting event data.

In some embodiments, the systems disclosed herein are further configured to compare the randomly assigned potential outcomes with one or more preset criterion for determining a payout award and distribute a payout award responsive to the satisfaction of the one or more preset criterion.

In some embodiments, the systems disclosed herein are further configured such that the random assignment of a potential outcome is responsive to receipt of a wager.

BRIEF DESCRIPTION OF THE DRAWINGS

The accompanying figures, in which like reference numerals refer to identical or functionally-similar elements throughout the separate views and which are incorporated in and form a part of the specification, further illustrate the invention and, together with the detailed description of the invention, serve to explain the principles of the invention.

DETAILED DESCRIPTION OF EMBODIMENTS OF THE INVENTION

Figure 1:
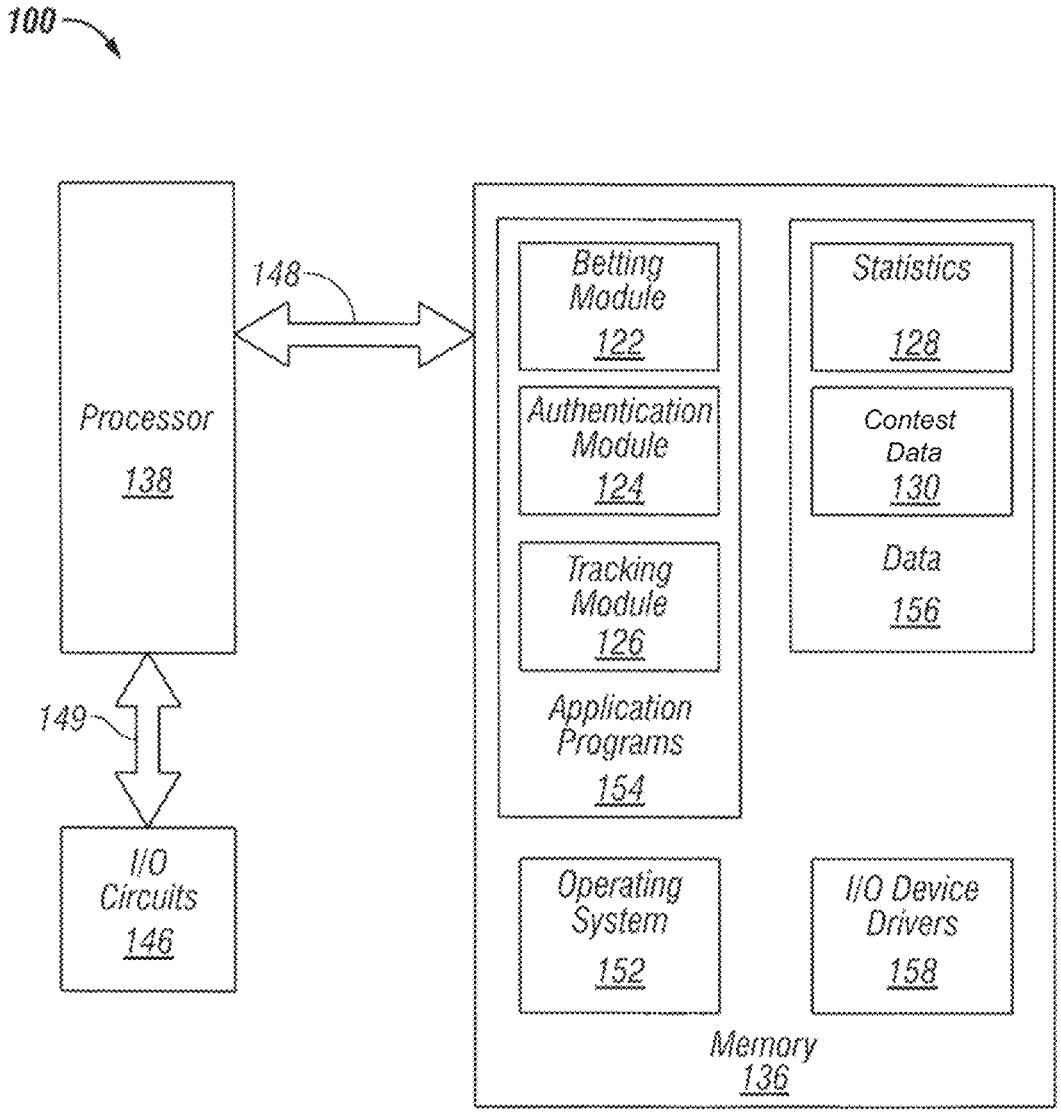
FIG. 1 illustrates a high-level block diagram of an exemplary data processing system or wagering module/database environment that may be included in devices operating in accordance with the disclosed embodiments.

The particular values and configurations discussed in these non-limiting examples can be varied and are cited merely to illustrate at least one embodiment and are not intended to limit the scope thereof.

The embodiments now will be described more fully hereinafter with reference to the accompanying drawings, in which illustrative embodiments of the invention are shown. The embodiments disclosed herein can be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As will be appreciated by one of skill in the art following the disclosure provided herein, the present invention can be embodied as a method, data processing system, or computer program product. Accordingly, the present invention may take the form of an entirely hardware embodiment, an entirely software embodiment or an embodiment combining software and hardware aspects all generally referred to herein as a "circuit" or "module." Furthermore, the present invention may take the form of a computer program product on a computer-usable storage medium having computer-usable program code embodied in the medium. Any suitable computer readable medium may be utilized, including hard disks, USB Flash Drives, DVDs, CD-ROMs, optical storage devices, magnetic storage devices, etc.

Computer program code for carrying out operations of the present invention may be written in an object oriented programming language (e.g., Java, C++, etc.) The computer program code, however, for carrying out operations of the present invention may also be written in conventional procedural programming languages, such as the "C" programming language or in a visually oriented programming environment, such as, for example, VisualBasic. The program code may execute entirely on the user's computer, partly on the user's computer, as a stand-alone software package, partly on the user's computer and partly on a remote computer or entirely on the remote computer.

A remote computer may be connected to a user's computer through a local area network (LAN) or a wide area network (WAN), wireless data network e.g., WiFi, Wimax, 802.xx, and cellular network or the connection may be made to an external computer via most third party supported networks (for example, through the Internet using an Internet Service Provider). A user's computer can include a portable electronic device, such as a smartphone or tablet computer, that can communicate wirelessly over data communications networks.

Authentication can include the use of user names, passcodes, biometrics, device identification, Portable electronic device location can also be determined based on GPS or via network communication. Authentication can also include the determination of a user's location based on the location of the user's portable electronic device.

The invention is described in part below with reference to flowchart illustrations and/or block diagrams of methods, systems, computer program products and data structures according to embodiments of the invention. It will be understood that each block of the illustrations, and combinations of blocks, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the block or blocks.

These computer program instructions may also be stored in a computer-readable memory that can direct a computer or other programmable data processing apparatus to function in a particular manner, such that the instructions stored in the computer-readable memory produce an article of manufacture, including instruction means which implement the function/act specified in the block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the block or blocks.

Referring now to FIG. 1, an exemplary data processing system 100 or wagering module/database environment that may be included in devices operating in accordance with some embodiments of the present invention will be discussed. As illustrated, the data processing system 100 includes a processor 138, a memory 136 and input/output circuits 146. The data processing system 100 may be incorporated in, for example, a personal computer, a portable wireless hand held device (e.g., Smartphone, etc), set top box, kiosk, terminal, sportsbook, smart tv, gaming server, router or the like. The processor 138 communicates with the memory 136 via an address/data bus 148 and communicates with the input/output circuits 146 via an address/data bus 149. The input/output circuits 146 can be used to transfer information between the memory 136 and another computer system or a network using, for example, an Internet Protocol (IP) connection and/or wireless or wired communications. These components may be conventional components such as those used in many conventional data processing systems, which may be configured to operate as described herein.

In particular, the processor 138 can be any commercially available or custom microprocessor, microcontroller, digital signal processor or the like. The memory 136 may include any memory devices containing the software and data used to implement the functionality circuits or modules used in accordance with embodiments of the present invention. The memory 136 can include, but is not limited to, the following types of devices: cache, ROM, PROM, EPROM, EEPROM, flash memory, SRAM, DRAM and magnetic disk. In some embodiments of the present invention, the memory 136 may be, for example, a content addressable memory (CAM).

As further illustrated in FIG. 1, the memory 136 may include several categories of software and data used in the data processing system 100: an operating system 152; application programs 154; input/output device drivers 158; and data 156. As will be appreciated by those of skill in the art, the operating system 152 may be any operating system suitable for use with a data processing system, such as, for example, Linux, Windows XP, Mac OS, Unix, etc. The input/output device drivers 158 typically include software routines accessed through the operating system 152 by the application programs 154 to communicate with devices such as the input/output circuits 146 and certain memory 136 components. The application programs 154 are illustrative of the programs that implement the various features of the circuits and modules according to some embodiments of the present invention. Finally, the data 156 represents static and dynamic data that can be used by the application programs 154, the operating system 152, the input/output device drivers 158, and other software programs that may reside in the memory 136. As illustrated in FIG. 1, the data 156 may include, for example, statistics 128 and contest-related data 130 (that is, parameters and variables, as discussed herein) for use by the circuits and modules of the application programs 154 according to some embodiments of the invention as discussed further herein. The contest information, for example, may include data associated with available parameters and variables for generating a contest entry. Statistics 128 may include, for example, not only statistical information related to available parameters and variables, but also broader statistics, such as, for example, historical statistics, results and scores.

In the embodiment shown in FIG. 1, applications programs 254 can include, for example, a wagering or betting module 122, a security or authentication module 124, a tracking module 126, and so forth. While the present invention is illustrated with reference to the betting module 122, the authentication module 124 and the tracking module 126 being application programs in FIG. 1, as will be appreciated by those of skill in the art, other configurations fall within the scope of the present invention. For example, rather than being application programs 154, these modules may also be incorporated into the operating system 152 or other such logical division of the data processing system 100.

Furthermore, while betting module 122, the authentication module 124 and the tracking module 126 are illustrated in a single data processing system, as will be appreciated by those of skill in the art, such functionality may be distributed across one or more data processing systems. Thus, the present invention should not be construed as limited to the configuration illustrated in FIG. 1, but may be provided by other arrangements and/or divisions of functions between data processing systems. For example, although FIG. 1 is illustrated as having various circuits/modules, one or more of these circuits may be combined without departing from the scope of the present invention.

Note that as utilized herein the term "module" generally refers to a collection or routines (and/or subroutines) and/or data structures that performs a particular task or implements a particular abstract data type. Modules usually include two parts: an interface, which lists the constants, data types, variables, and routines that can be accessed by other modules or routines, and an implementation, which is typically, but not always, private (accessible only to the module) and which contains the source code that actually implements the routines in the module. The term "module" may also refer to a self-contained component that can provide a complete function to a system and can be interchanged with other modules that perform similar functions.

Figure 2:
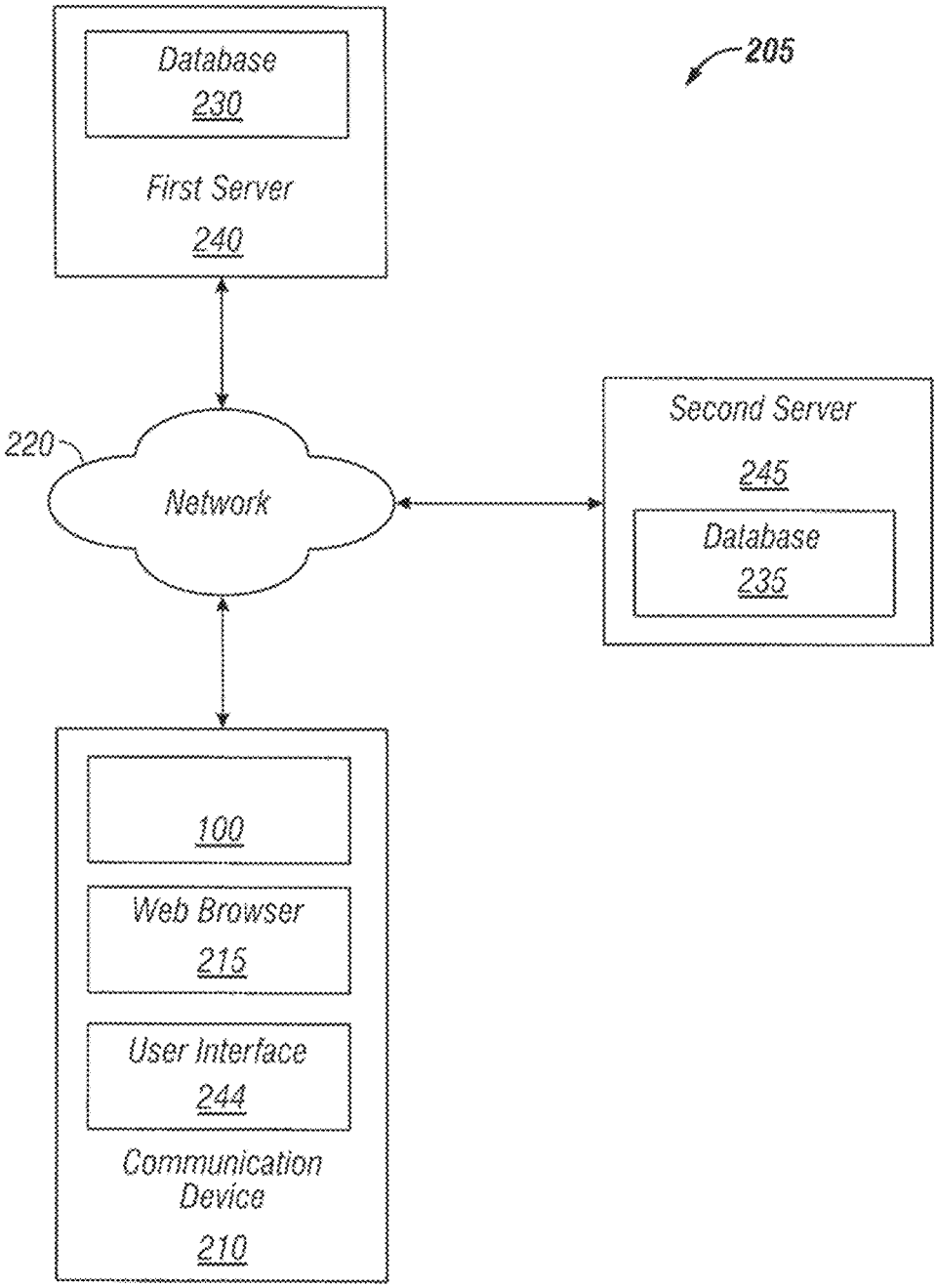
FIG. 2 illustrates an exemplary environment for operations and devices in accordance with the disclosed embodiments.

Referring now to FIG. 2, an exemplary environment 205 for operations and devices according to some embodiments of the present invention will be discussed. As illustrated in FIG. 2, the environment 205 may include a communications/computing device 210, a data communications network 220, a first server 240 and a second server 245. It can be appreciated that additional servers may be utilized with respect to network 220. It can also be appreciated that in some embodiments, only a single server, such as server 240 may be required. In general, the communications device 210 allows a user of the communications device 210 to view wagering options (available parameters and variables as discussed herein) and also to generate a game or contest ticket (e.g., which may include placing a wager using credits stored in a user account) into a secured game or contest of the invention utilizing bi-directional communications of the communications device 210 with one or more servers 235, 240, etc. over the data communications network 220.

As illustrated, the communications device 210 illustrated in FIG. 2 may include the wagering module or system 100 according to some embodiments of the invention discussed above with respect to FIG. 1. For example, the application programs 154 discussed with respect to FIG. 1 could be included as part of the wagering system module 100 of the communications device 210. Communications device 210 may be, for example, a remote device or a device within a casino or sportsbook, a laptop computer, a desktop computer, a smartphone, a kiosk, a terminal, a thin client or thick client device, or a web capable mobile terminal or any device capable of communicating with the network 220.

The communications device 210 may include, for example, a user interface 244, which may be used to view and select information, options and contest entries and tickets as discussed herein and enter wagers to generate tickets according to some embodiments of the present invention, and a web browser 215 that may be accessed through the user interface 244, according to some embodiments of the present invention. As discussed above, the wagering system module 100 may be configured to permit a user to place bets via the communications device 210. The first server 240 may include a database 230 and the second server 245 may include a database 235. The communications device 210 may communicate over the network 220, for example, the Internet, through a wireless communications link, an Ethernet connection, a telephone line, a digital subscriber link (DSL), a broadband cable link, other wireless links, etc. The first and second servers 240 and 245 may also communicate over the network 220. Thus, the network 220 may convey data between the communications device 210 and the first and second servers 240 and 245. The network 220 can be, for example, a wireless communications network, such as, for example, a cellular communications network or 802.11/WiFi network. The network 220 can also be a client-server network.

Figure 3:
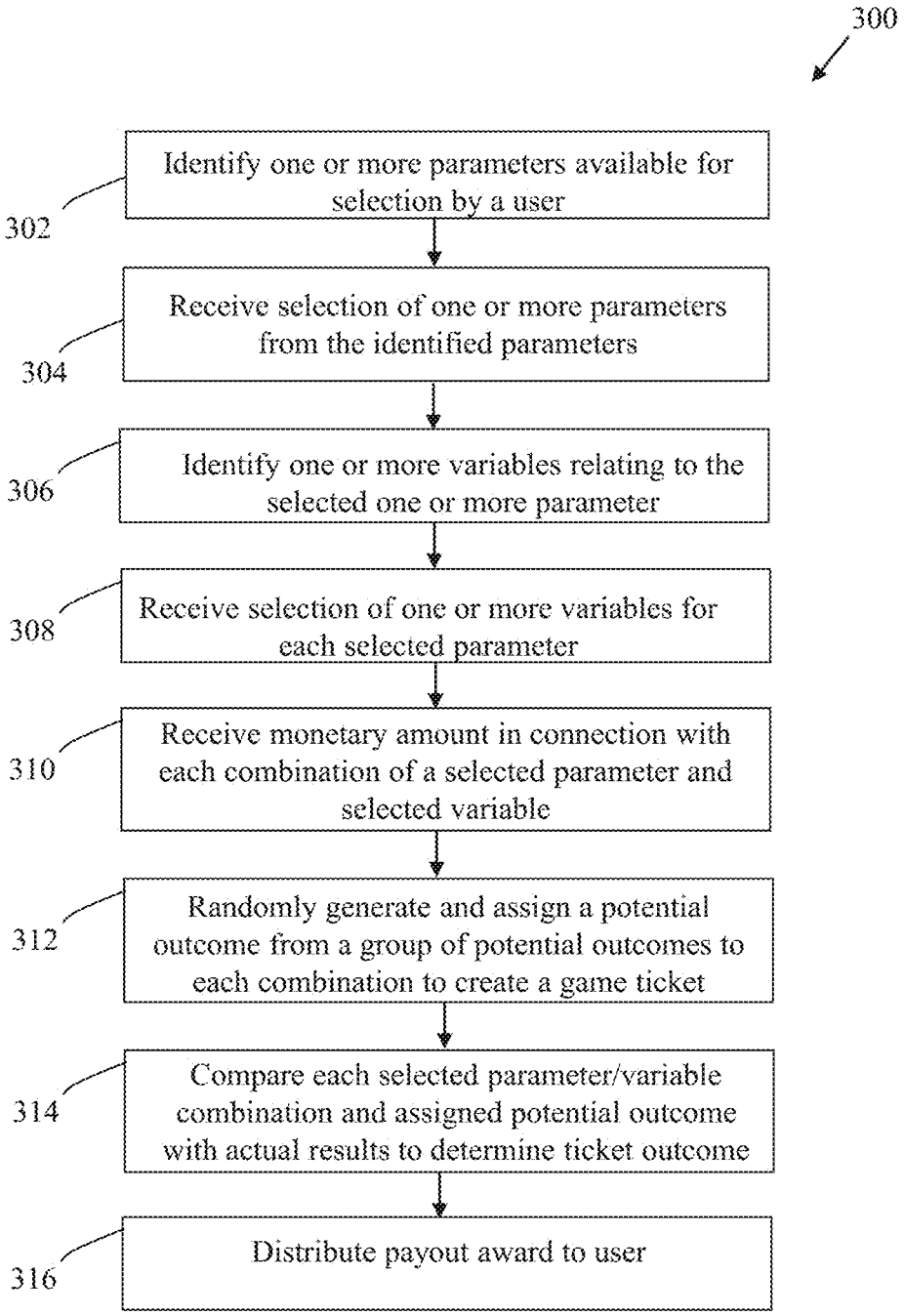
FIG. 3 illustrates a high-level flow chart of operations depicting logical operational steps of a method for enabling one or more users to wager on game tickets in accordance with some embodiments of the invention.

FIG. 3 illustrates a high-level flow chart of operations depicting logical operational steps of a method 300 for enabling one or more remote device users to wager on secure contests in a data network access to a gaming environment of the invention. As indicated at block 302, an operation can be implemented to identify one or more parameters available to be selected by a user utilizing a remote computing device, such as, for example, the remote computing/communications device 210 depicted in FIG. 2.

Once the one or more parameters have been identified (which may be a fixed item, categorical data, data point, statistic or statistical category, feature, outcome or occurrence of a sporting event, e.g., categories of the shots on goal in a hockey game, golf scores, racing events and finishing times, punches thrown, bowler scores, final scores, first quarter scores, final number of kills at game end, third period scores, fifteen minute point, etc., or alternatively, a selectable or random mix of one or more parameters), then a selection of one or more parameters from the identified parameters is received and processed at block 304. Responsive to the selection of identified one or more parameters, one or more variables relating to the selected parameter (e.g., one or more golf players, bowlers, race car drivers, players in an e-sports tournament, baseball teams, football teams, basketball teams, etc.) is identified and displayed or otherwise made available for selection as indicated at block 306. Alternatively, variables may be automatically selected or randomly selected from a pool of variables based on the selected parameter, such as the top five ranked players or all teams playing that day. It should be understood that the need for any random selections may be satisfied by a random number generator or program for providing the same which is included in or in communication with system 100. Alternatively, the variables may not be specifically identifiable. For example, if the selected parameter is final scores, then a selected variable may be the players finishing in the top ten of a tournament or the winning team of a tournament bracket.

Responsive to receiving selections of variables from the identified variables, a combination of each of the selected parameter and selected variables are formed at block 308. For descriptive purposes these combinations are referred to herein as forming a potential contest entry. It should be understood that embodiments of the invention may include any number of such combinations, which in some embodiments is used to provide a wagering game against a house or paytable, as opposed to being parimutuel or player vs player for example. Embodiments of the invention may employ various numbers of combinations which enable the scalability of the invention for offering large jackpots, which is not previously available in traditional sports wagering, but which is justifiable based on the associated probabilities possible through the systems and method of the invention.

As illustrated at block 310, a fee (i.e., a wager, bet, etc.), which may be debited from credits stored in a user account, can be placed with respect to the entry through a network, such as network 220, utilizing the device 210. Data indicative of the fee or bet is transmitted from the device 210 for placement of the bet via one or more servers (e.g., server 240, 235, etc.) in communication with the network 220.

It should be understood that the order and steps of a method of the invention such as method 300 as discussed herein may be changed or combined within the scope of the invention. For example, one or more parameters and/or variables, or combinations thereof, may be preselected, such as a first half scores for all teams playing in the first football games on Sunday, which may enable a user to select an already created contest entry at block 308 and submit a wager on the preselected contest at block 310. Alternatively, in some embodiments the entry fee is first received before the formation of the contest entry at block 308.

Responsive to the creation of the potential contest entry and receipt of a wager, an outcome from a group of potential outcomes is randomly generated or assigned to each selected parameter/variable combination to generate a completed wager at block 312 referred to herein as a contest ticket. The group of potential outcomes may be stored in memory, such as memory 136, in connection with or determined by the selected parameter. For example, if the selected parameter is third quarter scores in football games, then the group of potential outcomes may be an integer from zero to nine. A ticket generated at block 312 may be virtual and displayed on device 210 and/or printed.

The group of potential outcomes of a selected parameter may be modified, for any reason or reasons such as to control or change the potential odds and payouts accordingly. In some embodiments, the group of potential outcomes is preset and each selected parameter/variable combination is randomly assigned to one of the preset potential outcomes to generate a contest ticket at block 312. For example, the group of potential outcomes may be preset for every contest entry as odd numbers from one to nine (i.e., one, three, five, seven and nine) and five selected parameter/variable combinations may be created as described herein and then randomly assigned to each of the five odd numbers to form the game ticket. In other embodiments, a potential outcome from the group of potential outcomes is randomly generated and then selected by the user for each of the selected parameter/variable combinations to generate the ticket at block 312. In other embodiments, a potential outcome from the group of potential outcomes is selected by the user for each of the selected parameter/variable combinations to generate the ticket at block 312.

As shown at block 314 each of the selected parameter/variable combinations and corresponding potential outcomes are compared with actual results to determine a ticket outcome. For example, if the selected parameter/variable combinations on a ticket include (as the selected parameter) final game scores and (as the selected variables) two football teams playing in different games and two basketball teams playing against one another, and the randomly generated potential outcomes for each of the four combinations are four single digit integers from zero to nine, then the last digit of the actual final game scores of the two football teams and the two basketball teams are compared with the four randomly generated potential outcomes. In some embodiments, the combination may be a combined score of one or more teams, such as the teams playing against one another or teams in the division, and the last digit of the combined score is compared with the potential outcome.

A payout award is determined by system 100 based on the amount of matching combinations and potential outcomes with actual results and the determined odds of achieving the amount of matches. For example, a payout award may be distributed responsive to at least half of the combinations matching actual results and a jackpot, such as all or a part of a progressive jackpot, may be awarded responsive to all of the combinations being matched by actual results. Embodiments of the invention advantageously enable payout awards which are independent of the fees or wagers received and typical handicapping of sports wagers, that is, the payout awards are based on the probability of matching combinations with actual results. As shown at block 316, the determined payout award is distributed to the user, which may involve crediting a player or user account with the payout award as credits in some embodiments, such as where system 100 is used in connection with communication devices 210 being user smartphones and users generate tickets for play outside of a casino or sportsbook. Within a casino or sportsbook, a user may generate a printed ticket with the assistance of a teller and thereafter submit the ticket to a teller for a payout.

Figure 4:
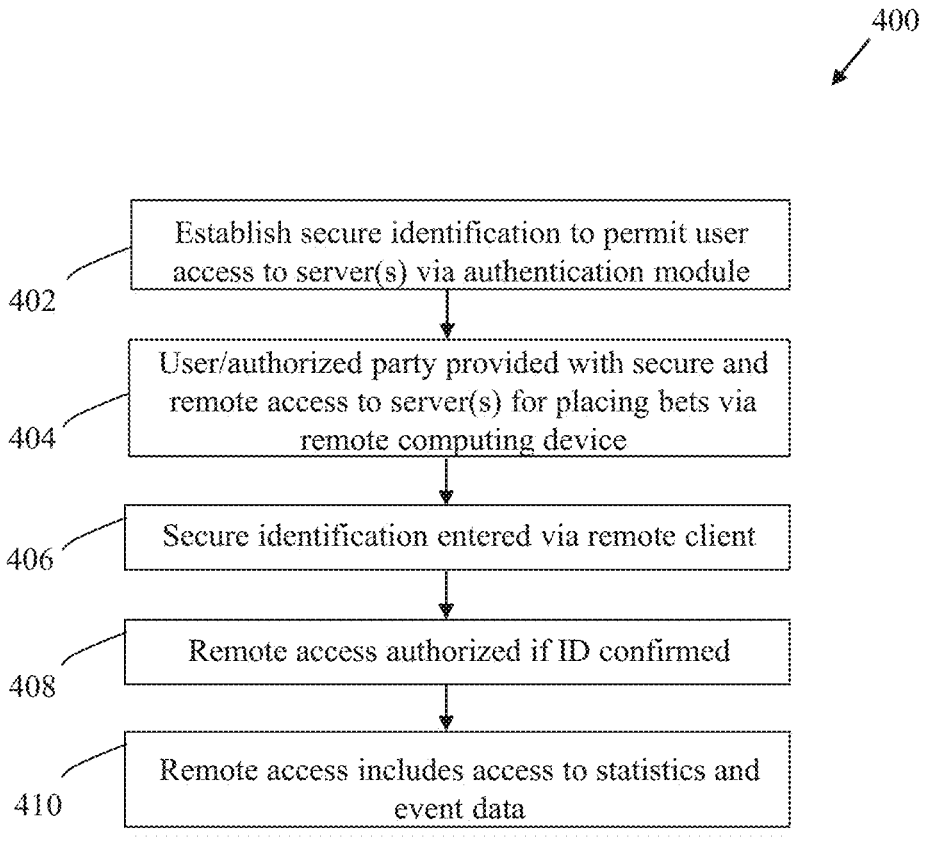
FIG. 4 illustrates a high-level flow chart of operations depicting a method for authentication of a user of a remote computing device, in accordance with the disclosed embodiments.

FIG. 4 illustrates a high-level flow chart of operations depicting an exemplary method 400 for authentication of a user of a remote computing device, such as a device 210 being a smartphone, in accordance with the disclosed embodiments. A similar method may be employed at a sports wagering terminal or kiosk. As illustrated at block 402, a secure identification can be established to permit a user of device 210 access to one or more of the servers 240, 245, etc. through the network 220 via the authentication module 124. Next, as depicted at block 404, the user/authorized party is provided with secure and remote access to one or more of the servers 240, 245 etc. for placing bets via remote computing device 210. The user of the remote computing device 210 can enter his or her secure identification via the remote computing device 210 as described at block 406. Remote access can then be granted to the user if his or her identification information is confirmed, as depicted at block 408. Remote access can, to one or more of the servers 240, 245, etc. via the network 220, include, for example, access to data relating to available parameters and variables for selection as well as to create an entry and/or generate a ticket by placing a wager as indicated at block 410 via the remote computing device 210. In some embodiments, a geolocation requirement must be satisfied prior to placing a wager to generate a ticket. The geolocation requirement may be satisfied by detecting the location of device 210 or any other industry-accepted method.

It should be noted that certain embodiments of the invention enable users to place a wager to generate a ticket on a game at any time, even after actual results are known, and therefore enable users to bet on historical results as well as future events through system 100. For example, if the selected parameter/variable combination is final scores for a number of teams and the potential outcomes from zero through nine are randomly assigned then the user has the same chance of achieving a payout award whether the games have started or ended. Thus, in some embodiments, users may generate a ticket comprising a selected parameter of games on the day a user was born and selecting football or basketball teams playing that day as variables, which can then be immediately resolved by a comparison of the selected combinations with randomly assigned potential outcomes against the historical results through system 100 access to statistics 128.

Figure 5:
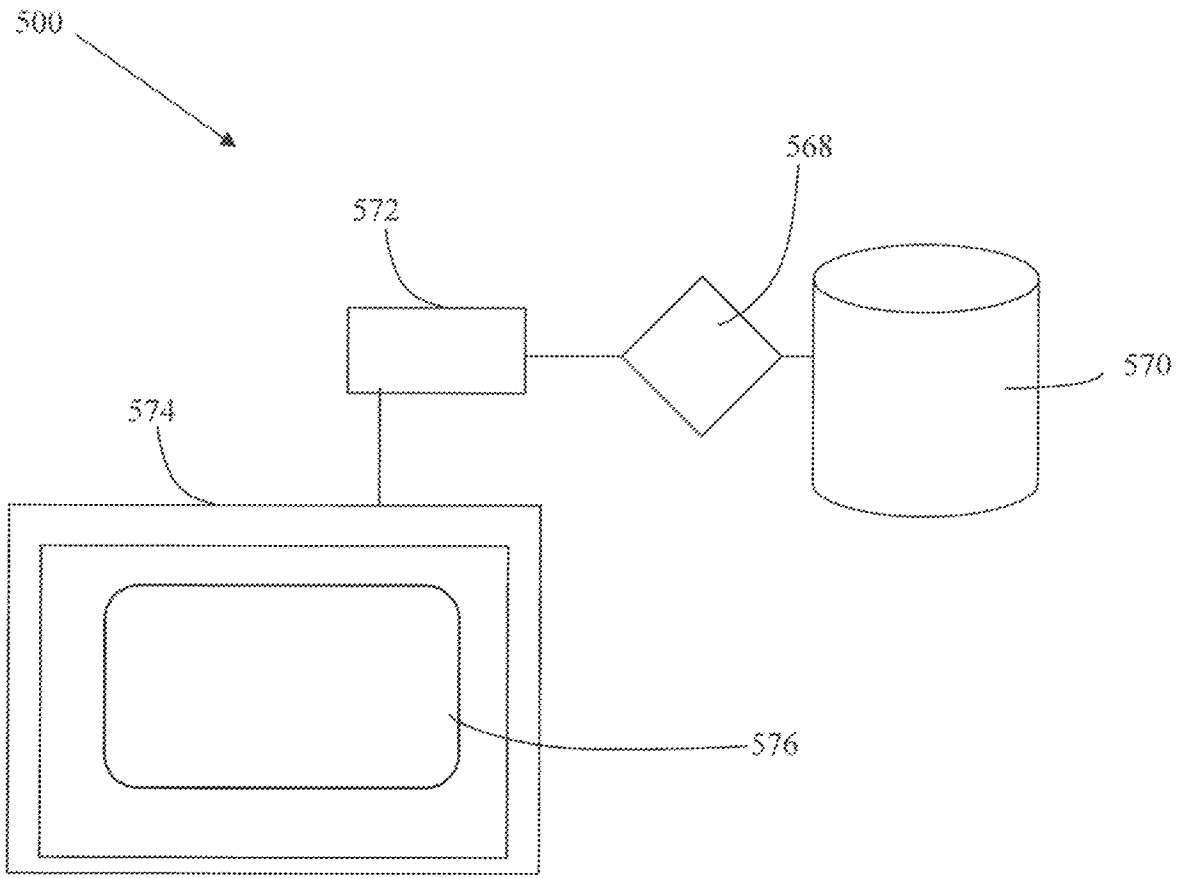
FIG. 5 is a schematic diagram depicting the components of an exemplary system configured and constructed according to some embodiments of the invention.

FIG. 5 illustrates a diagram of an exemplary system 500, which may be separate components or housed in a unitary remote or local computing device, constructed in accordance with some embodiments of the invention, and capable of connecting with system 100 through network 220. System 500 includes processing device 568 in communication with a database or memory device 570, communication or data input/output device 572 and a display device 574. In some embodiments, display device 574 is a touch-enabled device and includes a data input device component. Memory device 570 may include data relating to the underlying system and embodiments of the invention as described herein, such as the parameter, variable and potential outcome data and ticket generation information. A user interface 576 can be presented on display device 574. User interface 576 may be user interface 244 or any other interface for facilitating interactions with system 100 in accordance with any of the embodiments herein, such as enabling users to select from the available parameters and variables and place wagers to generate a ticket. System 100 information is displayed using display device 574 and processing device 568.

Figure 6:
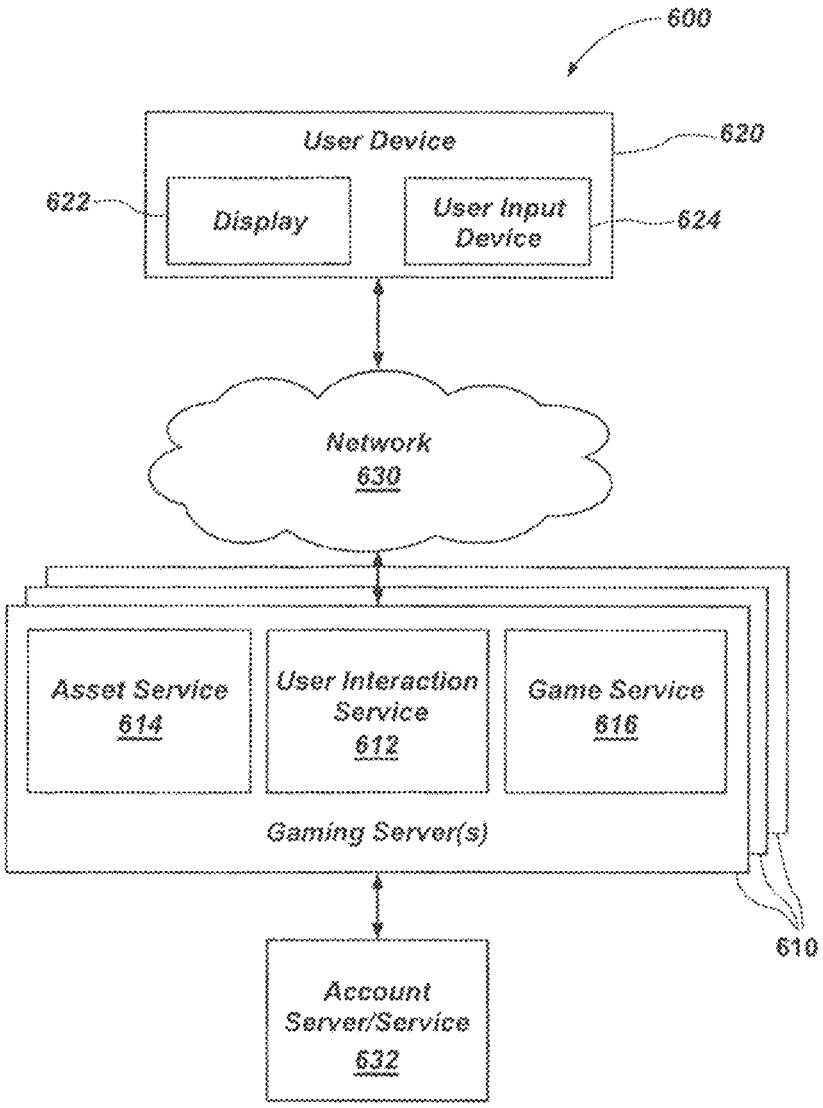
FIG. 6 is a schematic block diagram of a system configured for implementing embodiments of systems and methods of the invention.

In some embodiments, system 100, and other systems and methods in accordance with this invention, may be administered through a client-server architecture (e.g., over the Internet, a local area network, etc.). FIG. 6 is a schematic block diagram of an exemplary gaming system 600 for implementing gaming systems of the invention so that end users may remotely access the system to view historical data, select parameters and variables and generate a game or contest ticket as described herein, among other things.

Contests supported by the systems herein including gaming system 600 may be operated with real currency, cryptocurrency or with virtual credits or other virtual (e.g., electronic) value indicia. For example, the real currency option may be used and currency cashed out at the end of a season or upon sale of all shares. A user may be credited with real money or credits in any way allowed, including, but not limited to, a user purchasing credits, being awarded real money or credits as a payout on a ticket. In other embodiments, in which contest of the invention may be provided for trial, marketing or social gaming, for example, users may be awarded virtual credits upon logging in at a particular time, duration or with a particular frequency, etc., all of which may be tracked, such as by a module 126. Although credits may be won or lost, the ability of the user to cash out credits may be controlled or prevented.

An additional variation includes web-based sites having both play-for-fun and real money online gaming, including issuance of free (non-monetary) credits usable to play contests of the invention. This feature may attract users to the site and to the gaming system before placing money at stake. In some embodiments, a limited number of free or promotional credits may be issued to entice users to try the system of the invention.

Gaming system 600 may include a gaming platform to establish a portal for an end user to access a system of the invention hosted by one or more gaming servers 610 over a network 630. In embodiments, systems and user interface of the invention are accessed through a user interaction service 612. The gaming system 600 enables players to interact with a user device 620 through a user input device 624 and a display 622 and to communicate with one or more gaming servers 610 using a network 630 (e.g., network 200). Typically the user device is remote from the gaming server 610 and the network is the word-wide web (i.e., internet).

In some embodiments, the gaming servers 610 may be configured as a single server to administer systems of the invention in combination with the user device 620. In other embodiments, the gaming servers 610 may be configured as separate servers for performing separate, dedicated functions associated with administering the invention. Accordingly, the following description also discusses "services" with the understanding that the various services may be performed by different servers or combinations of servers in different embodiments. As shown in FIG. 6, the gaming servers 610 may include a user interaction service 612, a game service 616, and an asset service 614. In some embodiments, one or more of the gaming servers 610 may communicate with an account server 632 performing an account service 632. As explained more fully below, for some activities disclosed herein, the account service 632 may be separate and operated by a different entity than the gaming servers 610; however, in some embodiments the account service 632 may also be operated one or more of the gaming servers 610.

The user device 620 may communicate with the user interaction service 612 through the network 630. The user interaction service 612 may communicate with the game service 616 and provide player and other information, such as the information shown in interface 410, to the user device 620. A single user device 620 may communicate with system provided by the game service 616, while other embodiments may include a plurality of user devices 620 configured to communicate and provide end users with access to the same system provided by the game service 616, such as an identification of available parameters and variables. In addition, a plurality of end users may be permitted to access a single user interaction service 612, or a plurality of user interaction services 612, to access the game service 616. The user interaction service 612 may enable a user to create and access a user account and interact with game service 616. The user interaction service 612 may enable users to select a plurality of parameter/variable combinations and generate a contest ticket, for example.

The user interaction service 612 may also provide a client for execution on the user device 620 for accessing the gaming servers 610. The client provided by the gaming servers 610 for execution on the user device 620 may be any of a variety of implementations depending on the user device 620 and method of communication with the gaming servers 610. In one embodiment, the user device 620 may connect to the gaming servers 610 using a web browser, and the client may execute within a browser window or frame of the web browser. In another embodiment, the client may be a stand-alone executable on the user device 620.

For example, the client may comprise a relatively small amount of script, also referred to as a "script driver," including scripting language that controls an interface of the client. The script driver may include simple function calls requesting information from the gaming servers 610. In other words, the script driver stored in the client may merely include calls to functions that are externally defined by, and executed by, the gaming servers 610. As a result, the client may be characterized as a "thin client." The client may simply send requests to the gaming servers 610 rather than performing logic itself. The client may receive user inputs, and the user inputs may be passed to the gaming servers 610 for processing and executing the system of the invention. In some embodiments, this may involve providing specific graphical display information for the display 622.

As another example, the client may comprise an executable file rather than a script. The client may do more local processing than does a script driver, such as calculating where to show what player identification upon receiving a player valuation data. In some embodiments, portions of an asset service 614 may be loaded onto the client and may be used by the client in processing and updating graphical displays. Some form of data protection, such as end-to-end encryption, may be used when data is transported over the network 630. The network 630 may be any network, such as network 200.

The gaming servers 610 may include an asset service 614, which may host various media assets (e.g., text, audio, video, and image files) to send to the user device 620 for presenting the various parameter and variable information to the end user. In other words, the assets presented to the end user may be stored separately from the user device 620. For example, the user device 620 requests the assets appropriate for the user; as another example, especially relating to thin clients, just those assets that are needed for a particular display event will be sent by the gaming servers 610, including as few as one asset. The user device 620 may call a function defined at the user interaction service 612 or asset service 614, which may determine which assets are to be delivered to the user device 620 as well as how the assets are to be presented by the user device 620 to the end user on a user interface. Different assets may correspond to the various user devices 620 and their clients that may have access to the game service 616.

In some embodiments, components of the gaming system 600 may be operated by different entities. For example, the user device 620 may be operated by a third party, such as a betting terminal supplier or an individual, that links to the gaming servers 610, which may be operated, for example, by a game service provider. Therefore, in some embodiments, the user device 620 and client may be operated by a different administrator than the operator of the game service 616.

The gaming servers 610 may communicate with one or more external account servers 632 (also referred to herein as an account service 632), optionally through another firewall. For example, the gaming servers 610 may not directly accept fees or issue payouts. That is, the gaming servers 610 may facilitate the system of the invention but may not be part of a self-contained online operator itself. Another entity (e.g., an operator or any account holder or financial system of record) may operate and maintain its external account service 632 to accept money and make payout distributions. The gaming servers 610 may communicate with the account service 632 to verify the existence of funds as needed and to instruct the account service 632 to execute transactions which, in a system such as system 100, would be monitored by transaction module 106.

Additional features may be supported by the gaming servers 610, such as hacking and cheating detection, data storage and archival, metrics generation, messages generation, output formatting for different end user devices, as well as other features and operations.

Figure 7:
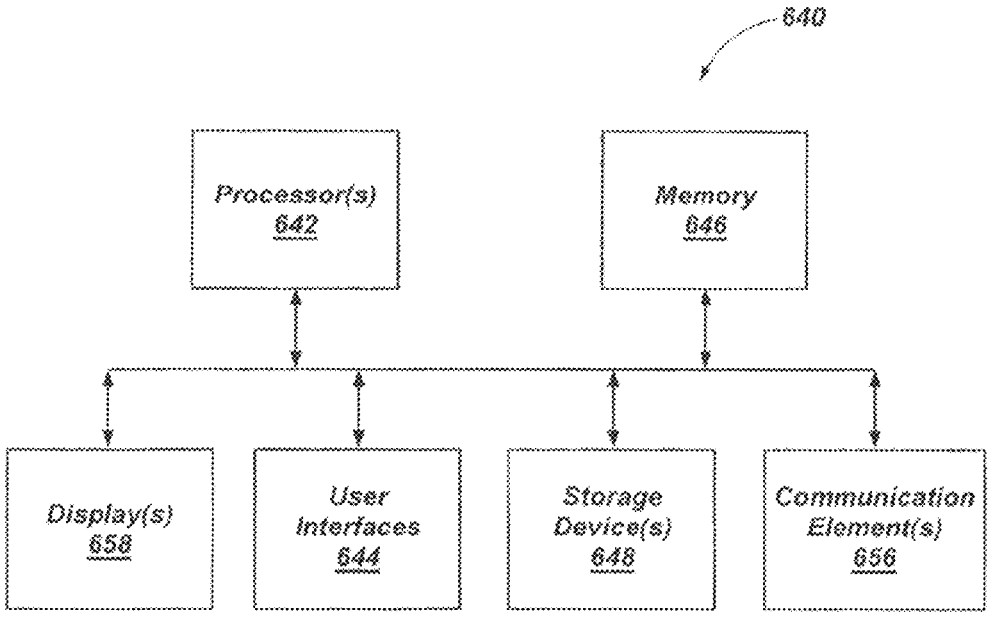
FIG. 7 is a schematic block diagram of a gaming system for implementing embodiments of the invention.

FIG. 7 is a simplified block diagram showing elements of additional computing devices that may be used in systems and apparatuses of this disclosure. The computing system 640 may be a user-type computer, a file server, a computer server, a notebook computer, a tablet, a handheld device, a mobile device, or other similar computer system for executing software. The computing system 640 may be configured to execute software programs containing computing instructions and may include one or more processors 642, memory 646, one or more displays 658, one or more user interface elements 644, one or more communication elements 656, and one or more storage devices 648 (also referred to herein simply as storage 648).

The processors 642 may be configured to execute a wide variety of operating systems and applications and the memory 646 may be used to hold computing instructions, data, and other information for performing a wide variety of tasks relating to the invention. By way of example, and not limitation, the memory 646 may include Synchronous Random Access Memory (SRAM), Dynamic RAM (DRAM), Read-Only Memory (ROM), Flash memory, and the like.

The display 658 may be a wide variety of displays such as, for example, light emitting diode displays, liquid crystal displays, cathode ray tubes, and the like. In addition, the display 658 may be configured with a touch-screen feature for accepting user input as a user interface element 644. As non-limiting examples, the user interface elements 644 may include elements such as displays, keyboards, push buttons, mice, joysticks, haptic devices, microphones, speakers, cameras, and touchscreens.

As non-limiting examples, the communication elements 656 may be configured for communicating with other devices or communication networks. As non-limiting examples, the communication elements 656 may include elements for communicating on wired and wireless communication media, such as for example, serial ports, parallel ports, Ethernet connections, universal serial bus (USB) connections, IEEE 1394 ("firewire") connections, Thunderbolt™ connections, Bluetooth® wireless networks, ZigBee wireless networks, 802.11 type wireless networks, cellular telephone/data networks, and other suitable communication interfaces and protocols.

The storage 648 may be used for storing relatively large amounts of nonvolatile information for use in the computing system 640 and may be configured as one or more storage devices. By way of example, and not limitation, these storage devices may include computer-readable media (CRM). This CRM may include, but is not limited to, magnetic and optical storage devices such as disk drives, magnetic tape, CDs (compact discs), DVDs (digital versatile discs or digital video discs), and semiconductor devices such as RAM, DRAM, ROM, EPROM, Flash memory, and other equivalent storage devices.

A person of ordinary skill in the art will recognize that the computing system 640 may be configured in many different ways with different types of interconnecting buses between the various elements. Moreover, the various elements may be subdivided physically, functionally, or a combination thereof. As one non-limiting example, the memory 646 may be divided into cache memory, graphics memory, and main memory. Each of these memories may communicate directly or indirectly with the one or more processors 642 on separate buses, partially-combined buses, or a common bus.

Figure 8:
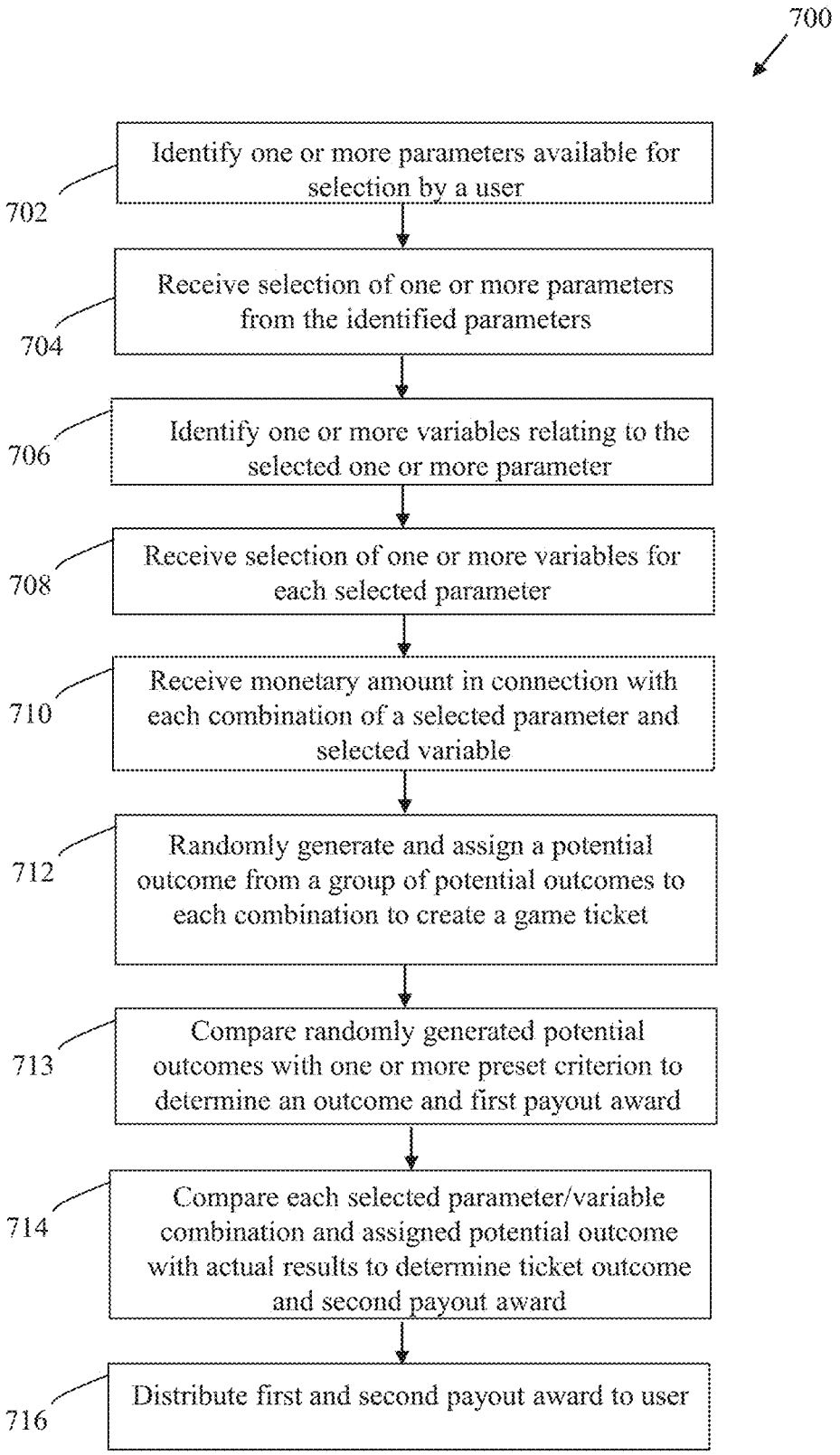
FIG. 8 illustrates another high-level flow chart of operations depicting logical operational steps of a method for enabling one or more users to wager on game tickets in accordance with another of the disclosed embodiments.

FIG. 8 illustrates a high-level flow chart of operations depicting a method 700 for wagering using a game or contest ticket of the invention. As illustrated at blocks 702 and 704, identifications of available parameters are transmitted to a user communication device for user selection and a selection of parameters is received from the user device. Alternatively, the selection of an available parameter is preset such that the user may begin at block 706 to view identified available variables based on the preset selected parameter. At block 708, selections of the variables are received to create one or more parameter/variable combinations for wagering on as shown at block 710. Responsive to receiving a wager in block 710, a game ticket is generated as indicated by block 712 by randomly assigning a potential outcome from a group of potential outcomes for the parameter to each of the parameter/variable combinations. In some embodiments the amount of the wager is preset.

In this embodiment, the contest ticket generated at block 712 actuates a second operation involving the comparison of the potential outcomes associated with each combination. At block 713, the potential outcomes are compared with one or more preset criterion for receiving a payout. The preset criterion for determining a payout may be immediately resolvable based on the potential outcomes on the ticket generated in block 712, that is, the outcome is determined based on the randomly generated potential outcomes themselves. For example, if the group of potential outcomes includes integers from zero to nine, a preset criterion for winning an award may be satisfied responsive to a certain number of the randomly generated potential outcomes being the same (e.g., three or more number sevens) or in order sequentially (e.g., potential outcomes of five, six, seven and eight). Should the preset criterion be satisfied at block 713, then a first payout award is distributed. As shown at block 714, each of the selected parameter/variable combinations and corresponding potential outcomes are compared with actual results to determine an outcome of the ticket and a second payout award. As shown at block 716, the first and/or second payout awards relating to the game ticket is distributed to the user.

Figure 9:
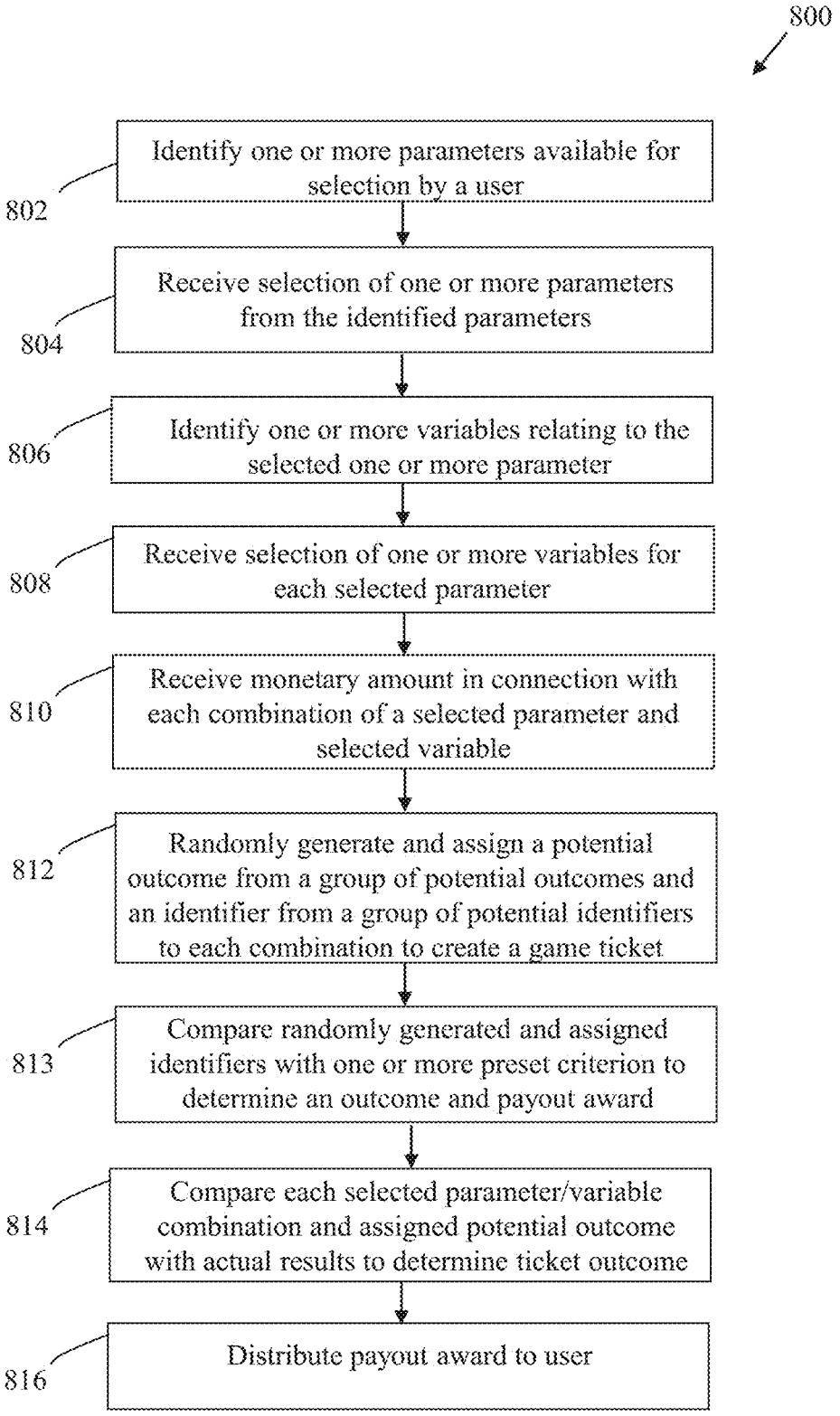
FIG. 9 illustrates a high-level flow chart of operations depicting logical operational steps of another method constructed in accordance with another of the disclosed embodiments.

FIG. 9 illustrates a high-level flow chart of operations depicting a method 800 for providing a wagering game contest and contest ticket of the invention. As illustrated at blocks 802 and 804, identifications of available parameters are transmitted to a user communication device for user selection and a selection of parameters is received from the user device. Alternatively, the selection of an available parameter is preset such that the user may begin at block 806 to view identified available variables based on the preset selected parameter. At block 808, selections of the variables are received to create one or more parameter/variable combinations for wagering on as shown at block 810. Responsive to receiving a wager in block 810, a game ticket is generated as indicated by block 812 by randomly assigning a potential outcome from a group of potential outcomes for the parameter to each of the parameter/variable combinations. In some embodiments the amount of the wager is preset such that only wagers of a fixed amount may be received.

In this embodiment, the contest ticket generated at block 812 includes conducting a second operation involving the association of one or more identifiers from a preset group of identifiers with items on the contest ticket. In some embodiments, each identifier is associated with a variable, such that each occurrence of the variable on the contest ticket is associated with the same identifier. In some embodiments, the identification is specific to each ticket. In other embodiments, the association of the identifier is made generally for all tickets. For example, in a game of the invention in which the selected parameter is preset as final score of all football games played that day, then an identifier may be associated with each team. In other embodiments, each identifier may be associated with each of the potential outcome and parameter/variable combinations. The operation of associating an identifier may be conducted randomly. For example, the preset group of identifiers can be colors, numbers or symbols, collectively or respectively, which are then randomly assigned or associated with each variable or combination. To illustrate, if the selected parameter is final scores in baseball games, and the selected variables include six teams, then each of the six combinations (i.e., the six teams and the respective corresponding potential outcomes) will be randomly associated with an identifier. To illustrate further, if the identifier is card symbols (i.e., spades, hearts, clubs and diamonds), then it is possible that the contest ticket generated at block 812 will include at least three of the same symbols from the symbols randomly associated with the six combinations.

At block 813, the identifiers are compared with one or more preset criterion for receiving a payout. The preset criterion for determining a payout may be immediately resolvable based on the identifiers on the ticket generated in block 812, that is, this portion of the wager received in step 810 is resolvable based solely on the identifiers randomly associated with the game ticket. For example, if the identifiers are integers from one to twenty, the identifiers may be compared with each potential outcome assigned to the combination associated with the identifier, and the preset criterion is satisfied responsive to the sum of the identifier and potential outcome equaling twenty one. As another example, if the identifiers are colors, then the preset criterion is satisfied at block 813 responsive to the colors randomly associated with the game ticket matching a preset pattern, such as four of the same color or a number of the same color being ordered sequentially or adjacent to another on a ticket. In other embodiments, the outcome of the identifiers is not immediately resolvable but rather is based on information to be determined, such as the identifiers being numbers which are then used as numbers for use in a keno-type game or lottery.

In some embodiments, various patterns may be used to form a paytable. The paytable may be expressed as multiples of the unit wager, fixed awards and/or portions of a progressive jackpot. The patterns of identifiers on the paytable may be comparable to poker hands, like two of a kind or full house, or unrelated to poker, such as one of each color from the group of possible colors.

In another example, the group of identifiers may include one or more special identifiers which result in a payout award if one or more of the special identifiers are assigned to a game ticket. For example, the identifiers may include a plurality of football helmets of various color and a few golden helmets which are associated with a payout award if randomly assigned to a game ticket of the invention.

As shown at block 814, each of the selected parameter/variable combinations and corresponding potential outcomes are compared with actual results to determine an outcome of the ticket or this part of the wager. As shown at block 816, a payout award relating to the game ticket is distributed to the user, which may include payout awards determined at blocks 813 and 814. In some embodiments, if the preset criterion is satisfied at block 813, then the corresponding payout award is immediately distributed prior to the ticket outcome being determined and payout awarded, as appropriate.

Figure 10:
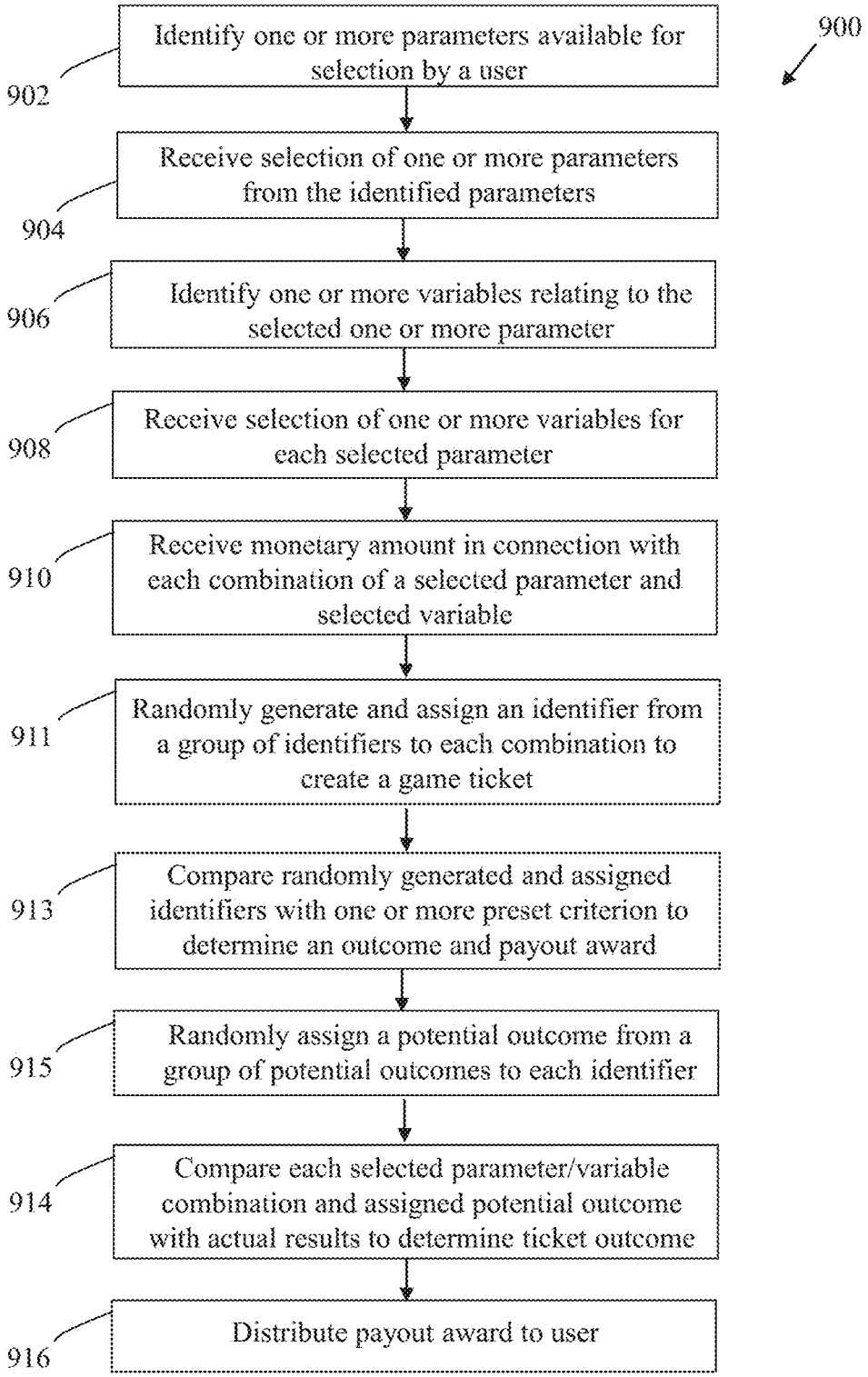
FIG. 10 illustrates a high-level flow chart of operations depicting logical operational steps of another method constructed in accordance with another of the disclosed embodiments.

FIG. 10 illustrates a high-level flow chart of operations depicting a method 900 for generating a wagering game and game ticket of the invention. As illustrated at blocks 902 and 904, identifications of available parameters are transmitted to a user communication device for user selection and a selection of parameters is received from the user device. Alternatively, the selection of an available parameter is preset such that the user may begin at block 906 to view identified available variables based on the preset selected parameter. At block 908, selections of the variables are received to create one or more parameter/variable combinations for wagering on as shown at block 910. Responsive to receiving a wager in block 910, a game ticket is generated as indicated by block 911 by assigning, randomly or otherwise, an identifier from a group of identifiers to each of the parameter/variable combinations or alternatively to each of the available variables. The identifiers may be any unique identification, such as a color or symbol. At block 913, the identifiers are compared with one or more preset criterion to determine an outcome of a secondary game in which a jackpot may be available depending on the preset criterion satisfied by the randomly assigned identifiers on the ticket. Thereafter, an operation involving the random selection of a potential outcome for each identifier in the group of identifiers is conducted as shown at block 915. Each identifier randomly assigned on a game ticket would correspond with a potential outcome and the game ticket may be updated accordingly.

It is envisioned that the operation at block 915 of randomly assigning a potential outcome to each identifier may be conducted at any time, including immediately prior to the beginning of each or all relevant variables or games. For example, the operation may be conducted on Sunday morning before the start of football games. This process may be advantageous for security reasons as well as being envisioned as creating additional user excitement. As shown at block 914, each of the selected parameter/variable combinations and corresponding potential outcomes (once revealed) are compared with the actual results to determine an outcome of the ticket. As shown at block 916, a payout award relating to the game ticket is distributed to the user, which may include payout awards determined at blocks 913 and 914

It will be understood that the circuits and other means supported by each block and combinations of blocks can be implemented by special purpose hardware, software or firmware operating on special or general-purpose data processors, or combinations thereof. It should also be noted that, in some alternative implementations, the operations noted in the blocks may occur out of the order noted in the figures. For example, two blocks shown in succession may, in fact, be executed substantially concurrently, or the blocks may sometimes be executed in the reverse order.

Figure 11:
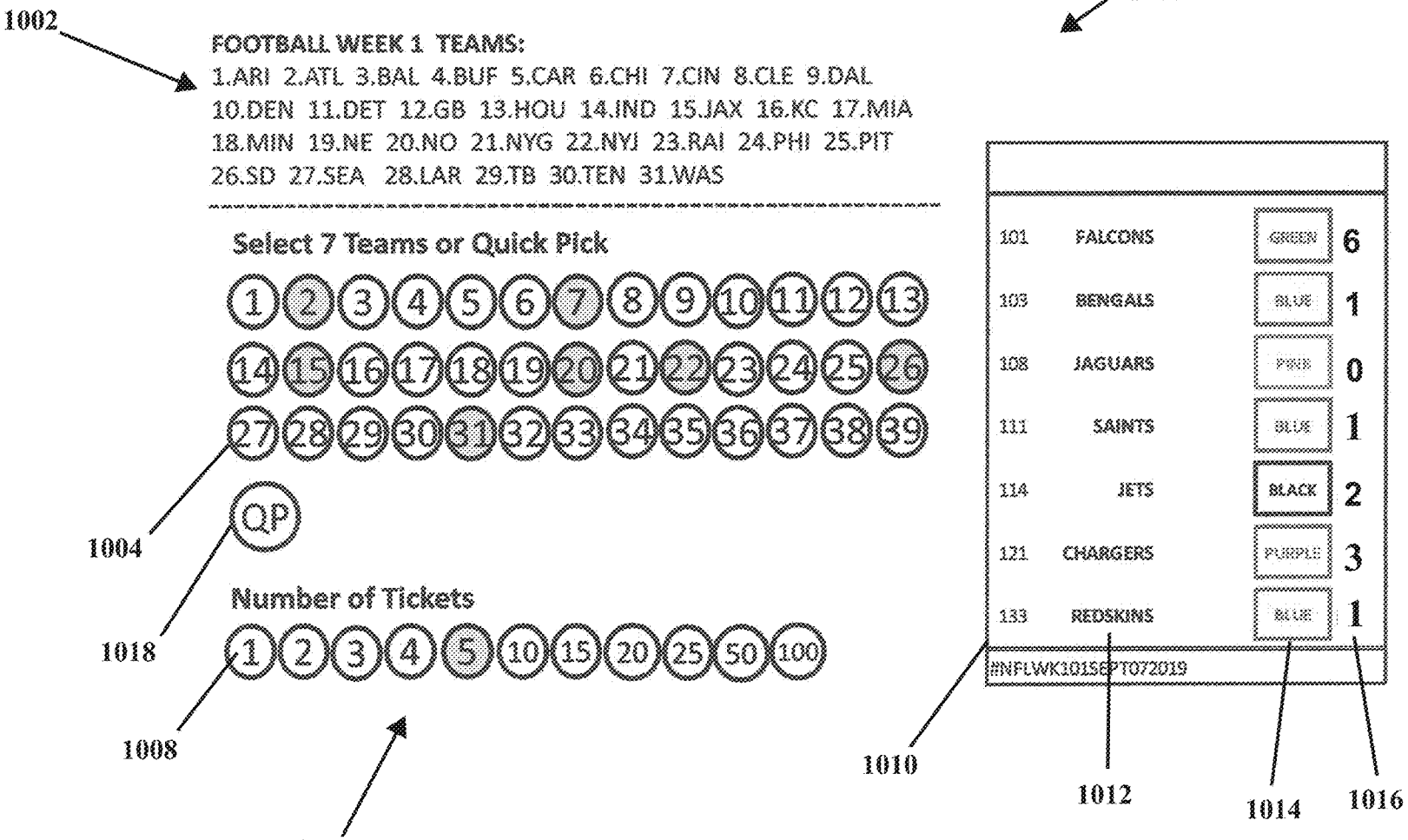
FIG. 11 illustrates an exemplary game or contest ticket generated according to some embodiments of the invention.

FIG. 11 illustrates an exemplary embodiment of the invention generally referred to by reference numeral 1000 which involves creation of a game ticket generated in accordance with the embodiments herein, such as method 900. In this embodiment, the parameter is preselected as a team's final game score and the available variables (the teams shown in area 1002) may be selected in area 1004 of game entry 1006. A user selects the teams by filling in the circles in area 1004 corresponding to the teams the user wishes to include in the wager. In this embodiment, the user selects seven teams from the pool of available teams and then selects the number of tickets in area 1008, which is five, and the wager amount, which may be one dollar. Thus, five dollars will be wagered and five game tickets generated in which the potential outcome and identifiers will be randomly generated for each ticket. This enables a user with the ability to make multiple wagers using the same variables and increases the user's probability of receiving a winning ticket and an instant win, among other things.

In this embodiment the identifiers are colors from a group of colors. Each color is randomly assigned to a preselected parameter/selected variable combination on each ticket. In this embodiment, if at least four of the seven colors are the same then the user receives a distribution of a payout award. An exemplary single game ticket 1010 is electronically displayed on a user device, such as a smartphone. Ticket 1010 includes the preselected parameter/selected variable combinations in area 1012 (shown only by the team name) and the randomly assigned identifier colors for each preselected parameter/selected variable combination shown in adjacent area 1014. Responsive to the random assignment of a potential outcome to each identifier, the potential outcome is shown in area 1016 on ticket 1010. In this instance, the potential outcomes are numbers zero to nine, which represents the potential outcome of a team score having the same number as its last digit. For example, in the embodiment shown, the identifier blue has been randomly assigned the number one, green has been randomly assigned the number six, pink has been randomly assigned the number zero and black has been assigned the number two. Thus, if the Jets scored twelve points in a game relating to the ticket (which may be included as part of the preselected parameter), then the assignment of the black identifier and corresponding potential outcome of two means this combination is won by the user. If a user has multiple cards or tickets in which there are multiple instances of the same color then each instance would result in the same randomly assigned number being associated with the color.

In some embodiments, the potential outcomes are generated only after no more wagers are permitted for the contest. In some embodiments, a game ticket can be generated across a plurality of teams playing as games are played if the selected parameter is a combined or team score at each quarter, or a combined or team score every five minutes, etc. This embodiment also includes a "quick pick" option in Tillable circle 1018, in which the teams are randomly selected when a wager is received to generate a ticket.

Some portions of the disclosure are presented in terms of algorithms (e.g., as represented in flowcharts, prose descriptions, or both) and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic, or optical signals capable of being stored, transferred, combined, compared, and otherwise manipulated. It is convenient at times, principally for reasons of common usage, to refer to these signals as bits, values, elements, symbols, characters, terms, numbers, or the like. Furthermore, it is also convenient at times to refer to certain arrangements of steps requiring physical manipulations or transformation of physical quantities or representations of physical quantities as modules or code devices, without loss of generality. However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing," "computing," "calculating," "determining," "displaying," "determining," or the like, refer to the action and processes of a computer system, or similar electronic computing device (such as a specific computing machine), that manipulates and transforms data represented as physical (electronic) quantities within the computer system memories or registers or other such information storage, transmission or display devices.

Certain aspects of the embodiments include process steps and instructions described herein in the form of an algorithm. It should be noted that the process steps and instructions of the embodiments can be embodied in software, firmware, or hardware, and when embodied in software, could be downloaded to reside on and be operated from different platforms used by a variety of operating systems. The embodiments can also be in a computer program product, which can be executed on a computing system.

Some embodiments also relate to an apparatus for performing the operations herein. Such an apparatus may be specially constructed for the purposes, e.g., a specific computer, or it may comprise a general-purpose computer selectively activated or reconfigured by a computer program stored in the computer. Such a computer program may be stored in a computer-readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Memory can include any of the above and/or other devices that can store information/data/programs and can be a transient or non-transient medium, where a non-transient or non-transitory medium can include memory/storage that stores information for more than a minimal duration. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the method steps. The structure for a variety of these systems will appear from the description herein. In addition, the embodiments are not described with reference to any particular programming language. It will be appreciated that a variety of programming languages may be used to implement the teachings of the embodiments as described herein, and any references herein to specific languages are provided for the purposes of enablement and best mode.

Those skilled in the art will appreciate that the types of software and hardware used are not vital to the full implementation of the methods of the invention. The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

While exemplary systems and methods, and applications of methods of the invention, have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Additional information regarding exemplary embodiments of the invention is provided below.

In some embodiments, the methods, systems, and media disclosed herein include at least one computer program, or use of the same. A computer program includes a sequence of instructions, executable in the digital processing device's CPU, written to perform a specified task. Computer readable instructions may be implemented as program modules, such as functions, objects, Application Programming Interfaces (APIs), data structures, and the like, that perform particular tasks or implement particular abstract data types. In light of the disclosure provided herein, those of skill in the art will recognize that a computer program may be written in various versions of various languages.

The functionality of the computer readable instructions may be combined or distributed as desired in various environments. In some embodiments, a computer program comprises one sequence of instructions. In some embodiments, a computer program comprises a plurality of sequences of instructions. In some embodiments, a computer program is provided from one location. In other embodiments, a computer program is provided from a plurality of locations. In various embodiments, a computer program includes one or more software modules. In various embodiments, a computer program includes, in part or in whole, one or more web applications, one or more mobile applications, one or more standalone applications, one or more web browser plug-ins, extensions, add-ins, or add-ons, or combinations thereof.

In some embodiments, a computer program includes a web application. In light of the disclosure provided herein, those of skill in the art will recognize that a web application, in various embodiments, utilizes one or more software frameworks and one or more database systems. In some embodiments, a web application is created upon a software framework such as Microsoft® .NET or Ruby on Rails (RoR). In some embodiments, a web application utilizes one or more database systems including, by way of non-limiting examples, relational, non-relational, object oriented, associative, and XML database systems. In further embodiments, suitable relational database systems include, by way of non-limiting examples, Microsoft® SQL Server, mySQL™ and Oracle®. Those of skill in the art will also recognize that a web application, in various embodiments, is written in one or more versions of one or more languages. A web application may be written in one or more markup languages, presentation definition languages, client-side scripting languages, server-side coding languages, database query languages, or combinations thereof. In some embodiments, a web application is written to some extent in a markup language such as Hypertext Markup Language (HTML), Extensible Hypertext Markup Language (XHTML), or eXtensible Markup Language (XML). In some embodiments, a web application is written to some extent in a presentation definition language such as Cascading Style Sheets (CSS). In some embodiments, a web application is written to some extent in a client-side scripting language such as Asynchronous Javascript and XML (AJAX), Flash® Actionscript, Javascript, or Silverlight®. In some embodiments, a web application is written to some extent in a server-side coding language such as Active Server Pages (ASP), ColdFusion®, Perl, Java™, JavaServer Pages (JSP), Hypertext Preprocessor (PHP), Python™, Ruby, Tcl, Smalltalk, WebDNA®, or Groovy. In some embodiments, a web application is written to some extent in a database query language such as Structured Query Language (SQL). In some embodiments, a web application integrates enterprise server products such as IBM® Lotus Domino®. In some embodiments, a web application includes a media player element. In various further embodiments, a media player element utilizes one or more of many suitable multimedia technologies including, by way of non-limiting examples, Adobe® Flash®, HTML 5, Apple® QuickTime®, Microsoft® Silverlight®, Java™, and Unity®.

In some embodiments, a computer program includes a mobile application provided to a mobile digital processing device. In some embodiments, the mobile application is provided to a mobile digital processing device at the time it is manufactured. In other embodiments, the mobile application is provided to a mobile digital processing device via the computer network described herein.

In view of the disclosure provided herein, a mobile application is created by techniques known to those of skill in the art using hardware, languages, and development environments known to the art. Those of skill in the art will recognize that mobile applications are written in several languages. Suitable programming languages include, by way of non-limiting examples, C, C++, C#, Objective-C, Java™, Javascript, Pascal, Object Pascal, Python™, Ruby, VB.NET, WML, and XHTML/HTML with or without CSS, or combinations thereof.

Suitable mobile application development environments are available from several sources. Commercially available development environments include, by way of non-limiting examples, AirplaySDK, alcheMo, Appcelerator®, Celsius, Bedrock, Flash Lite, .NET Compact Framework, Rhomobile, and WorkLight Mobile Platform. Other development environments are available without cost including, by way of non-limiting examples, Lazarus, MobiFlex, MoSync, and Phonegap. Also, mobile device manufacturers distribute software developer kits including, by way of non-limiting examples, iPhone and iPad (iOS) SDK, Android™ SDK, BlackBerry® SDK, BREW SDK, Palm® OS SDK, Symbian SDK, webOS SDK, and Windows® Mobile SDK.

Those of skill in the art will recognize that several commercial forums are available for distribution of mobile applications including, by way of non-limiting examples, Apple® App Store, Android™ Market, BlackBerry® App World, App Store for Palm devices, App Catalog for webOS, Windows® Marketplace for Mobile, Ovi Store for Nokia® devices, Samsung® Apps, and Nintendo® DSi Shop.

In some embodiments, a computer program includes a standalone application, which is a program that is run as an independent computer process, not an add-on to an existing process, e.g., not a plug-in. Those of skill in the art will recognize that standalone applications are often compiled. A compiler is a computer program(s) that transforms source code written in a programming language into binary object code such as assembly language or machine code. Suitable compiled programming languages include, by way of non-limiting examples, C, C++, Objective-C, COBOL, Delphi, Eiffel, Java™, Lisp, Python™, Visual Basic, and VB .NET, or combinations thereof. Compilation is often performed, at least in part, to create an executable program. In some embodiments, a computer program includes one or more executable complied applications.

In some embodiments, the methods, systems, and media disclosed herein include software, server, and/or database modules, or use of the same. In view of the disclosure provided herein, software modules are created by techniques known to those of skill in the art using machines, software, and languages known to the art. The software modules disclosed herein are implemented in a multitude of ways. In various embodiments, a software module comprises a file, a section of code, a programming object, a programming structure, or combinations thereof. In further various embodiments, a software module comprises a plurality of files, a plurality of sections of code, a plurality of programming objects, a plurality of programming structures, or combinations thereof. In various embodiments, the one or more software modules comprise, by way of non-limiting examples, a web application, a mobile application, and a standalone application. In some embodiments, software modules are in one computer program or application. In other embodiments, software modules are in more than one computer program or application. In some embodiments, software modules are hosted on one machine. In other embodiments, software modules are hosted on more than one machine. In further embodiments, software modules are hosted on cloud computing platforms. In some embodiments, software modules are hosted on one or more machines in one location. In other embodiments, software modules are hosted on one or more machines in more than one location.

In some embodiments, the methods, systems, and media disclosed herein include one or more databases, or use of the same. In view of the disclosure provided herein, those of skill in the art will recognize that many databases are suitable for storage and retrieval of user and player share information. In various embodiments, suitable databases include, by way of non-limiting examples, relational databases, non-relational databases, object oriented databases, object databases, entity-relationship model databases, associative databases, and XML databases. In some embodiments, a database is internet-based. In further embodiments, a database is web-based.

In still further embodiments, a database is cloud computing-based. In other embodiments, a database is based on one or more local computer storage devices.

General information relating to various embodiments of the invention is provided below. A controller, computing device, or computer, such as described herein, may include at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

In some embodiments, a controller may include a processor, which as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Other aspects and features of the invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Those skilled in the art will readily appreciate that the systems and methods described herein may be a standalone system, gaming device, gaming machine or incorporated in an existing gaming system or machine. The gaming machine of the invention may include various computer and network related software and hardware, such as programs, operating systems, memory storage devices, data input/output devices, data processors, servers with links to data communication systems, wireless or otherwise, and data transceiving terminals. It should also be understood that any method steps discussed herein, such as for example, steps involving the receiving or displaying of data, may further include or involve the transmission, receipt and processing of data through conventional hardware and/or software technology to effectuate the steps as described herein. Those skilled in the art will further appreciate that the precise types of software and hardware used are not vital to the full implementation of the methods of the invention so long as players and operators thereof are provided with useful access thereto, either through a mobile device, gaming platform, or other computing platform via a local network or global telecommunication network.

Although specific features of various embodiments of the invention may be shown in some drawings and not in others, this is for convenience only. In accordance with the principles of the invention, any feature of a drawing may be referenced and/or claimed in combination with any feature of any other drawing.

Those skilled in the art will readily appreciate that the apparatus described herein may include various computer and network related software and hardware, such as programs, operating systems, memory storage devices, data input/output devices, data processors, servers with links to data communication systems, wireless or otherwise, and data transceiving terminals. Those skilled in the art will further appreciate that the precise types of software and hardware used are not vital to the full implementation of the apparatus of the invention so long as it performs as described in at least one of the embodiments herein.

While exemplary apparatus, systems and methods of the invention have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the scope of the invention in any way. Accordingly, the invention embraces alternatives, modifications and variations which fall within the spirit and scope of the invention as set forth by the claims and any equivalents thereto.

The invention claimed is:

1. A system for secure sports wagering, comprising a game server including a computing device in communication with a communication network, a user device and a random number generator, the computing device comprising a processor and a memory device configured to store a plurality of parameters, each parameter of the plurality relating to statistical data generated by a sporting event, a plurality of variables relating to each parameter of the plurality of parameters, each variable relating to a preset participant in the sporting event, a plurality of potential outcomes and a plurality of executable instructions stored therein, the system being configured to:

a) actuate the game server to generate a display on the user device of the plurality of parameters;

b) receive a selected parameter from the user device;

c) display one or more variables relating to the selected parameter on the user device;

d) receive a selection of one or more variables for the selected parameter from the one or more variables displayed on the user device;

e) randomly assign a potential outcome from the plurality of potential outcomes to each combination of the selected parameter and the one or more selected variables;

f) compare the potential outcome for each combination of the selected parameter and the one or more selected variables with actual sporting event data received through the communication network; and g) distribute a payout responsive to the potential outcome for each combination of the selected parameter and the selected one or more variables at least partially corresponding with the actual sporting event data.

2. A system for secure sports wagering, comprising a game server including a computing device in communication with a communication network, a user device and a random number generator, the computing device comprising a processor and a memory device configured to store a plurality of statistical categories of data collected from one or more sporting events, a plurality of participants in the one or more sporting events, a plurality of potential outcomes for the sporting event and a plurality of executable instructions stored therein, the system being configured to:

a) actuate the game server to generate a display on the user device of the plurality of statistical categories of data collected from one or more sporting events;

b) receive a selected statistical category of data from the user device;

c) display the plurality of participants in the one or more sporting events relating to the selected statistical category of data;

d) receive a selection of one or more participants from the plurality of participants displayed on the user device;

e) randomly assign a potential outcome from the plurality of potential outcomes to each combination of the selected statistical category of data and selected participant;

f) compare the potential outcome for each combination with actual sporting event data involving the participant received through the communication network; and g) distribute a payout responsive to the potential outcome for each combination at least partially corresponding with the actual sporting event data.

3. A system according to claim 2, wherein the system is further configured to compare the randomly assigned potential outcomes with one or more preset criterion for determining a payout award and distribute a payout award responsive to the satisfaction of the one or more preset criterion.

* * * * *